US008388057B2

(12) United States Patent
Barkow et al.

(10) Patent No.: US 8,388,057 B2
(45) Date of Patent: Mar. 5, 2013

(54) AIR-CONDITIONED SEAT

(75) Inventors: Tomas Barkow, Braunschweig (DE); Heinz Etzmuss, Seelze (DE); Hans-Georg Kaiser, Ostheim r.d. Rhõu (DE); Bernd Wilhelm, Braunschweig (DE); Harald Vogel, Cottbus (DE); Adrian Sievers, Alfeld (DE); Reinhard Mueller, Braunschweig (DE)

(73) Assignees: Volkswagen AG, Wolfsburg (DE); Sitech Sitztechnik GmbH, Wolfsburg (DE)

( * ) Notice: Subject to any disclaimer, the term of this patent is extended or adjusted under 35 U.S.C. 154(b) by 532 days.

(21) Appl. No.: 12/375,342

(22) PCT Filed: Jul. 11, 2007

(86) PCT No.: PCT/EP2007/006124

§ 371 (c)(1),
(2), (4) Date: Aug. 18, 2009

(87) PCT Pub. No.: WO2008/011984

PCT Pub. Date: Jan. 31, 2008

(65) Prior Publication Data

US 2009/0322124 A1 Dec. 31, 2009

(30) Foreign Application Priority Data

Jul. 27, 2006 (DE) ..... 10 2006 035 541

(51) Int. Cl.
*A47C 7/72* (2006.01)

(52) U.S. Cl. ..... 297/180.14

(58) Field of Classification Search ..... 297/180.14, 297/180.13, 452.42
See application file for complete search history.

(56) References Cited

U.S. PATENT DOCUMENTS 4,726,086 A * 2/1988 McEvoy ..... 5/653
6,179,706 B1 1/2001 Yoshinori et al.
6,196,627 B1 * 3/2001 Faust et al. ..... 297/180.14

(Continued)

FOREIGN PATENT DOCUMENTS

DE 199 27 232 12/1999
DE 199 54 978 1/2001

(Continued)

OTHER PUBLICATIONS

International Search Report, PCT/EP2007/006124, dated Sep. 12, 2008.

(Continued)

*Primary Examiner* — Milton Nelson, Jr.
(74) *Attorney, Agent, or Firm* — Kenyon & Kenyon LLP

(57) ABSTRACT

An air-conditioned seat includes a seat area and a backrest, the seat area and/or the backrest being cushioned with foam. For climate-control, a ventilator, in particular a radial ventilator, is provided, which is in operative connection with an air distribution device in the foam of the seat area and/or the backrest, the air distribution device including an air distribution structure on the side (e.g., a B side) facing away from the seated person, as well as air-conducting channels toward the side (e.g., an A side) facing the seated person. The ventilator is to be disposed in the foam itself, on the B side. The air is transported to the A side via the air distribution structure in the form of air trenches introduced into the foam on the B side, and via the air-conducting channels.

23 Claims, 19 Drawing Sheets

U.S. PATENT DOCUMENTS

| | | | | |
|---|---|---|---|---|
| 6,629,725 | B1 | 10/2003 | Kunkel et al. | |
| 6,746,076 | B2 * | 6/2004 | Bogisch et al. | 297/180.14 |
| 7,213,876 | B2 * | 5/2007 | Stoewe | 297/180.14 |
| 2004/0090093 | A1 | 5/2004 | Kamiya et al. | |
| 2009/0127894 | A1 * | 5/2009 | Bargheer et al. | 297/180.1 |

FOREIGN PATENT DOCUMENTS

| | | |
|---|---|---|
| DE | 200 02 447 | 2/2001 |
| DE | 202 19 733 | 4/2004 |
| WO | 2006/079400 | 8/2006 |

OTHER PUBLICATIONS

International Preliminary Report on Patentability and Written Opinion, International Application No. PCT/EP2007/006124, dated Feb. 17, 2009.

* cited by examiner

AIR-CONDITIONED SEAT

FIELD OF THE INVENTION

The present invention relates to an air-conditioned seat.

BACKGROUND INFORMATION

An air-conditioned seat is described in German Published Utility Model No. 202 19 733. In this seat, a ventilator, for example a radial ventilator, is situated below the seat area—at a distance from it. Via a passage region below the seat, air is transported into an air distribution device in the seat cushion, which includes an air distribution structure on the underside of the seat area, air ducts and air outlets on the top side of the seat area.

SUMMARY

Example embodiments of the present invention provide for positioning both the air distribution device as well as the ventilator itself in the foam material. This makes it possible to position the radial ventilator in a vibration-damped manner by fixating it in the cushioning foam. This additionally provides that the components mentioned in the related art such as passage regions and conveyor housings between the external radial blower and the seat cushion may be omitted.

The radial ventilator positioned in the foam is in direct operative connection with an air distribution structure integrated into the foam in the form of air trenches or air channels.

Example embodiments of the present invention are described in more detail below with reference to the figures.

BRIEF DESCRIPTION OF THE DRAWINGS

FIG. 10 illustrates the system as shown in FIG. 1 using a harder material/rubber skin in the air trenches that can be sprayed on.

DETAILED DESCRIPTION

Figure 1:
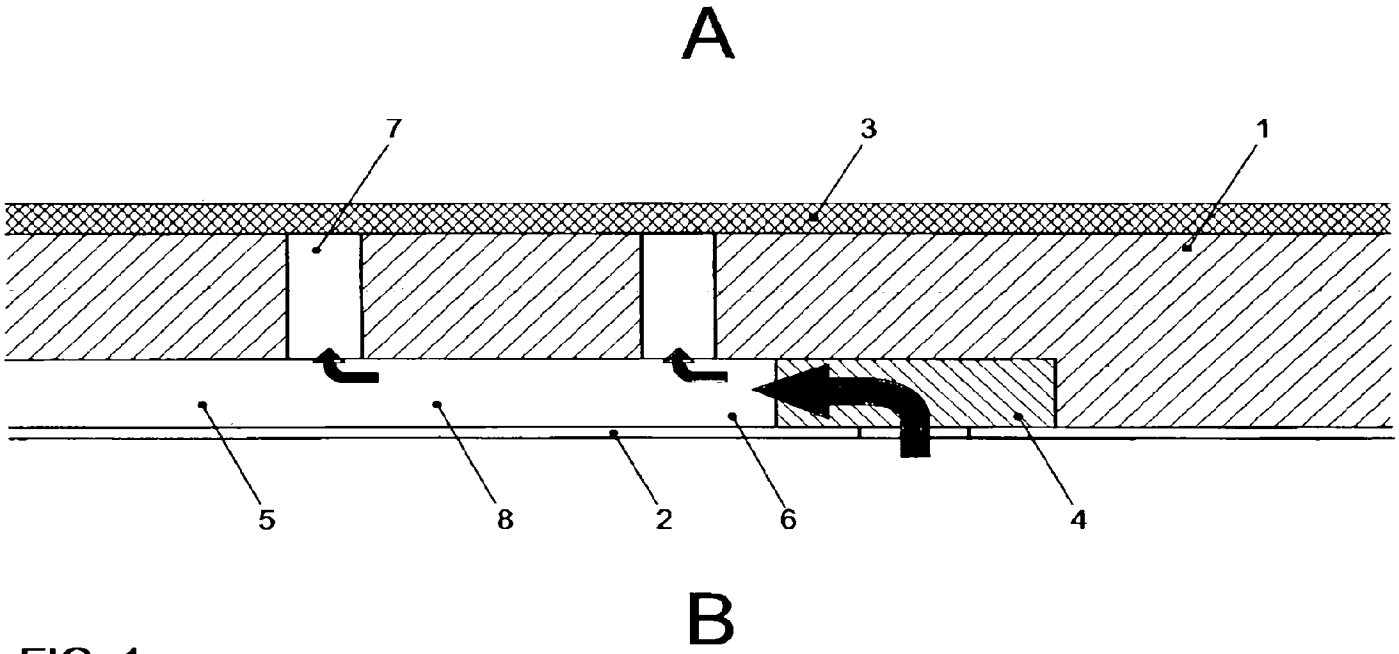
FIG. 1 is a cross-sectional view of a seat cushion or seat back cushion of a seat having a radial ventilator positioned in accordance with example embodiments of the present invention.

On the basis of a cross-section, FIG. 1 shows the construction of a seat back or a seat part 22, the cushioning foam 1 being bounded by a non-woven fabric 2 on the side facing away from the seated person (hereinafter called the B side). On the side facing the seated person (hereinafter called the A side), the foam is enveloped by a cover 3. For active ventilation, a radial ventilator 4 is provided, which is positioned in the foam itself in a vibration-damped manner, on the B side. The seat area or the seat back furthermore has an air distribution device 5, which in this instance has an air distribution structure 6 and air conducting channels 7 situated transversely with respect to it. Air distribution structure 6 is made up of air trenches 8 or air channels integrated directly into the foam and extending along the B side, and not of a knitted spacer fabric layer. Air is thus aspirated by radial ventilator 4 into the foam, subsequently distributed across the seat cushion or seat back cushion through air trenches 8 of air distribution structure 6, and then transported to the A side of the seat part (compare course of arrows) via air conducting channels 7.

In principle, the seat provided in accordance with example embodiments of the present invention may be provided without a knitted spacer fabric and thus without a separate air-permeable layer. Air-conducting channels 7 and trenches 8 are integrated into the foam cushioning.

Figure 2:
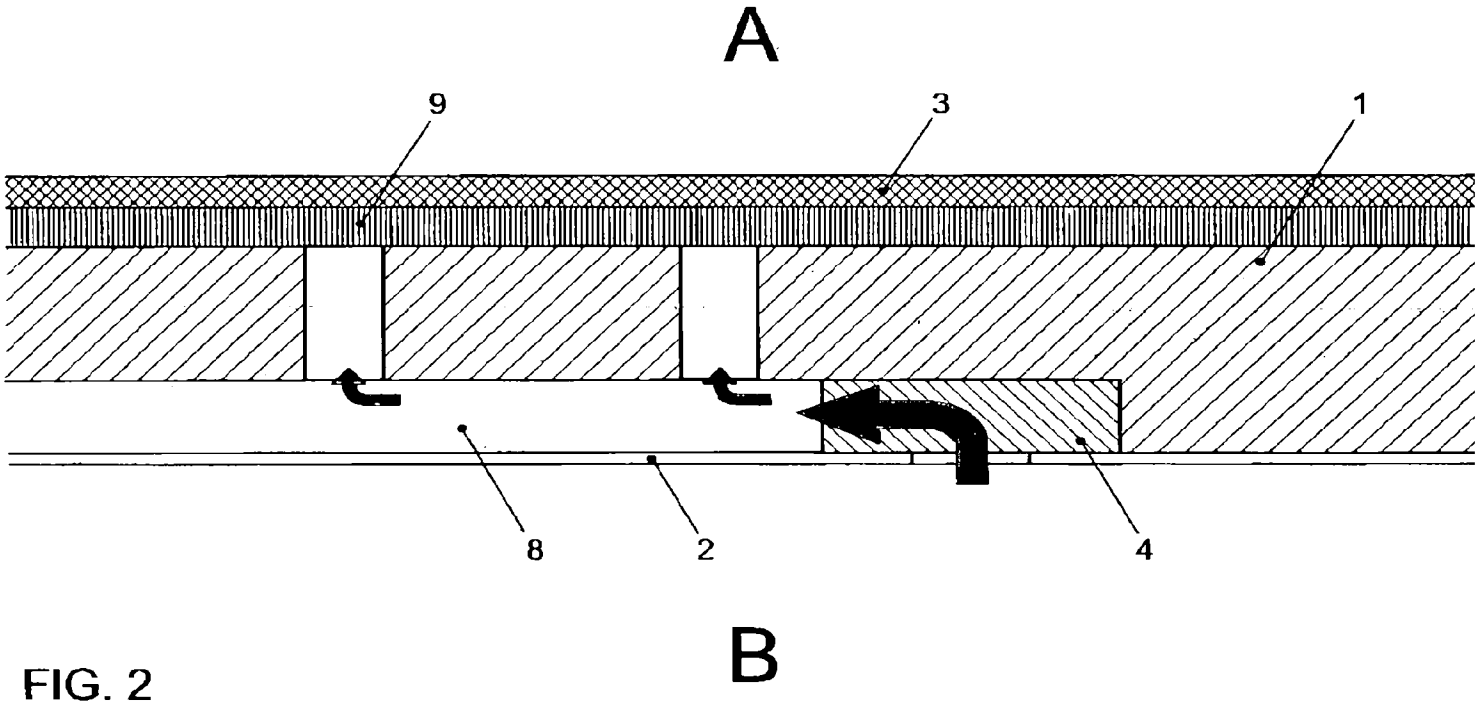
FIG. 2 illustrates the system as shown in FIG. 1 having a knitted spacer fabric on the A side.
Figure 3:
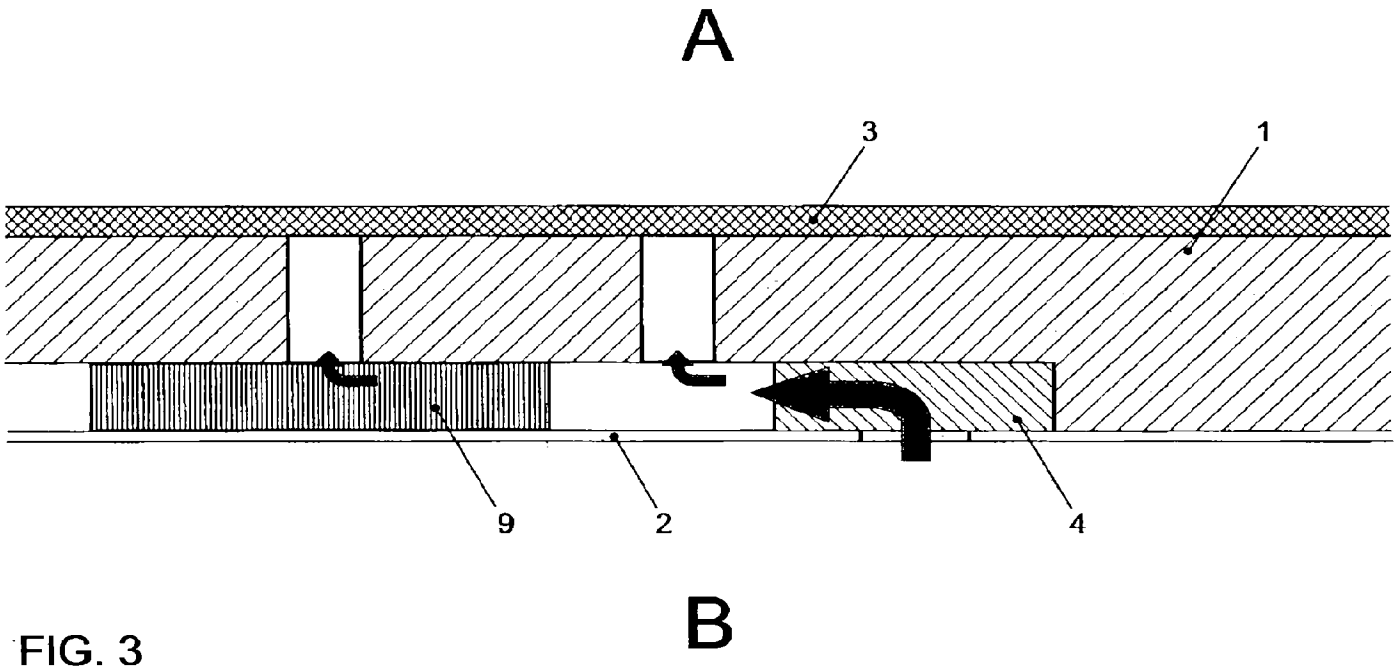
FIG. 3 illustrates the system as shown in FIG. 1 having a knitted spacer fabric on the B side.

It is also possible, however, to use knitted spacer fabrics. These may then be situated both on the A side as well as on the B side of the seat back or seat part 22. FIG. 2 shows the arrangement of a knitted spacer fabric 9 or also of rubberized hair between foam 1 and cover 3 on the A side. Alternatively or additionally, knitted spacer fabric 9 or the rubberized hair may be situated on the B side, that is, within air trenches 8 of air distribution structure 6 (FIG. 3).

Figure 4:
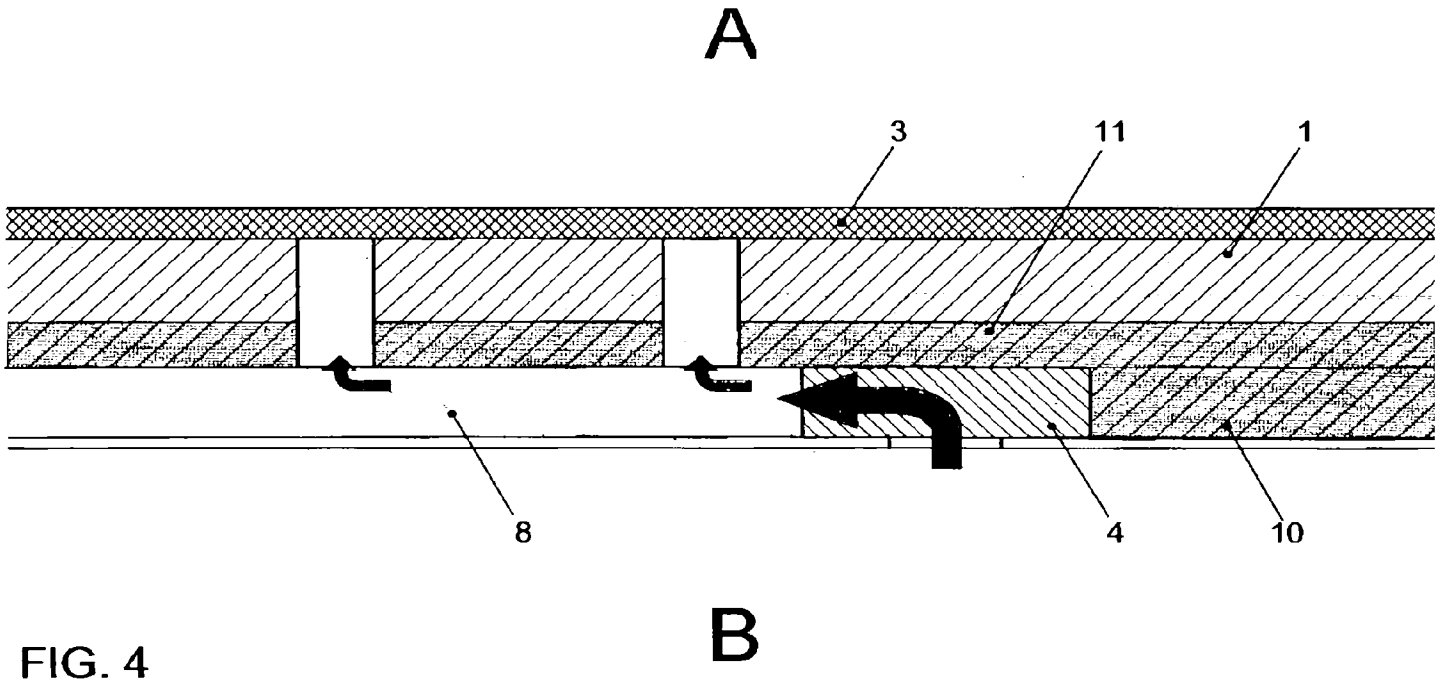
FIG. 4 illustrates the system as shown in FIG. 1 using a 2-zone foam.

So that air trenches 8 on the B side are not compressed and hampered in their effectiveness when a load is applied by a sitting person, the cushioning foam is made from a 2-zone foam (compare FIG. 4). The A side is provided using a softer foam, while the B side is formed from a harder foam, which thus stabilizes air trenches 8. Zone boundary 11 between the lower, harder foam and the upper, softer foam extends above air trenches 8. In this manner, radial ventilator 4 is stabilized as well and protected from loading.

Figure 5:
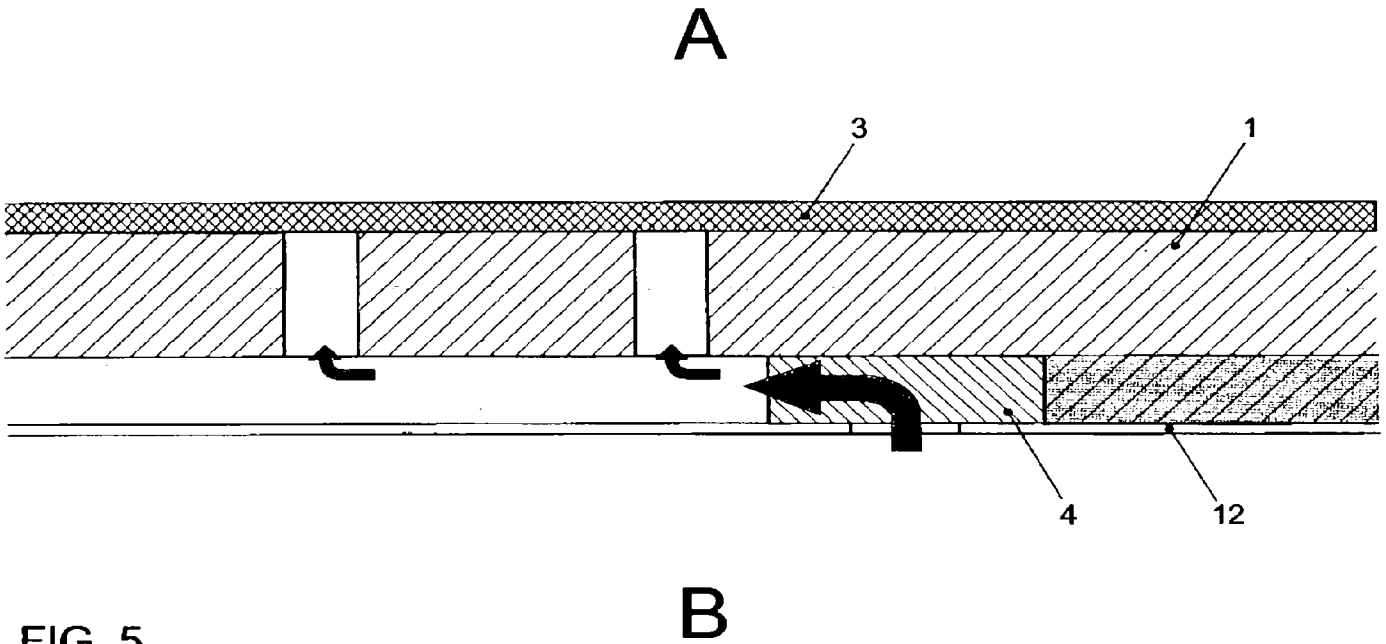
FIG. 5 illustrates the system as shown in FIG. 1 using a fixating foam for the ventilator, which is glued onto the foam.

In addition, FIG. 5 shows that such a stabilization or fixation of radial ventilator 4 is also achieved by a separate foam zone or foam layer 12, which is applied, preferably glued, onto the cushioning foam near the ventilator. This separate foam consequently holds the ventilator.

Figure 6:
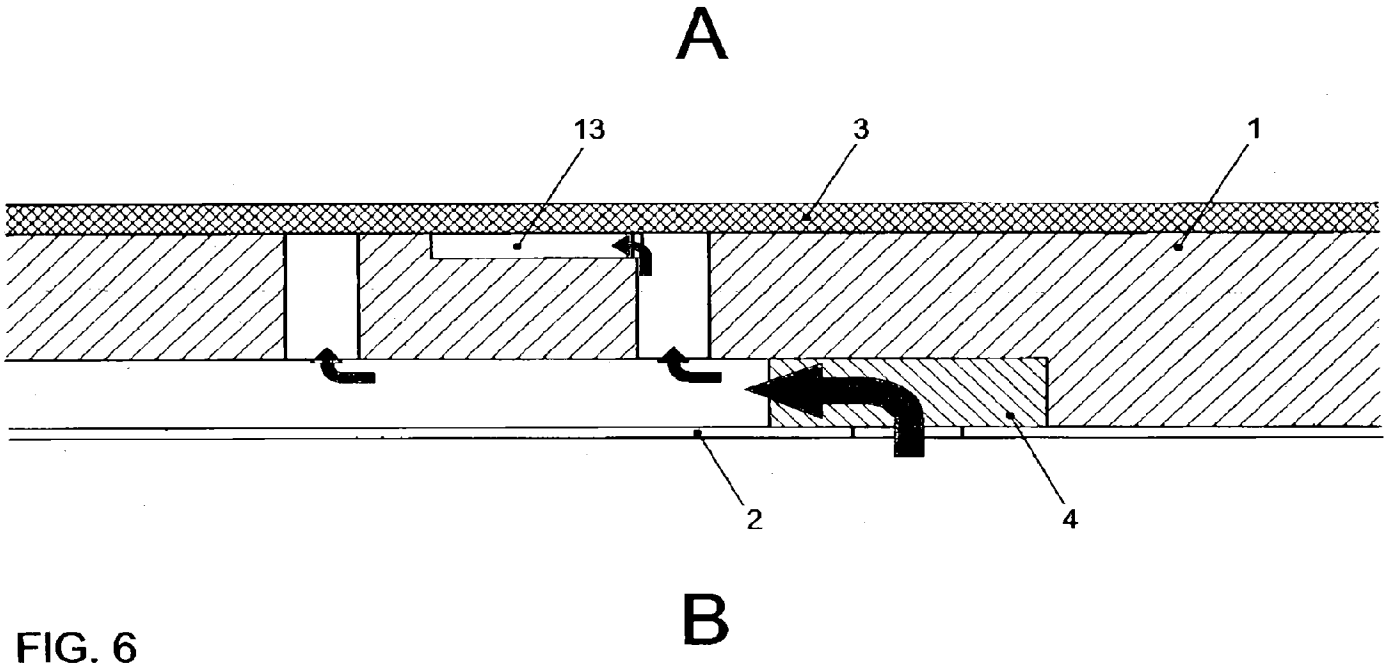
FIG. 6 illustrates the system as shown in FIG. 1 using air trenches on the A side.

An air distribution structure having air trenches may also be integrated into the A side of the cushioning foam (FIG. 6) in addition to the B side. In addition to air conducting channels 7 on the A side, air trenches 13 adjoining these air conducting channels 13 are then also introduced into foam 1, for example by cutting. The air may then be delivered to greater distribution regions on the A side.

Figure 7:
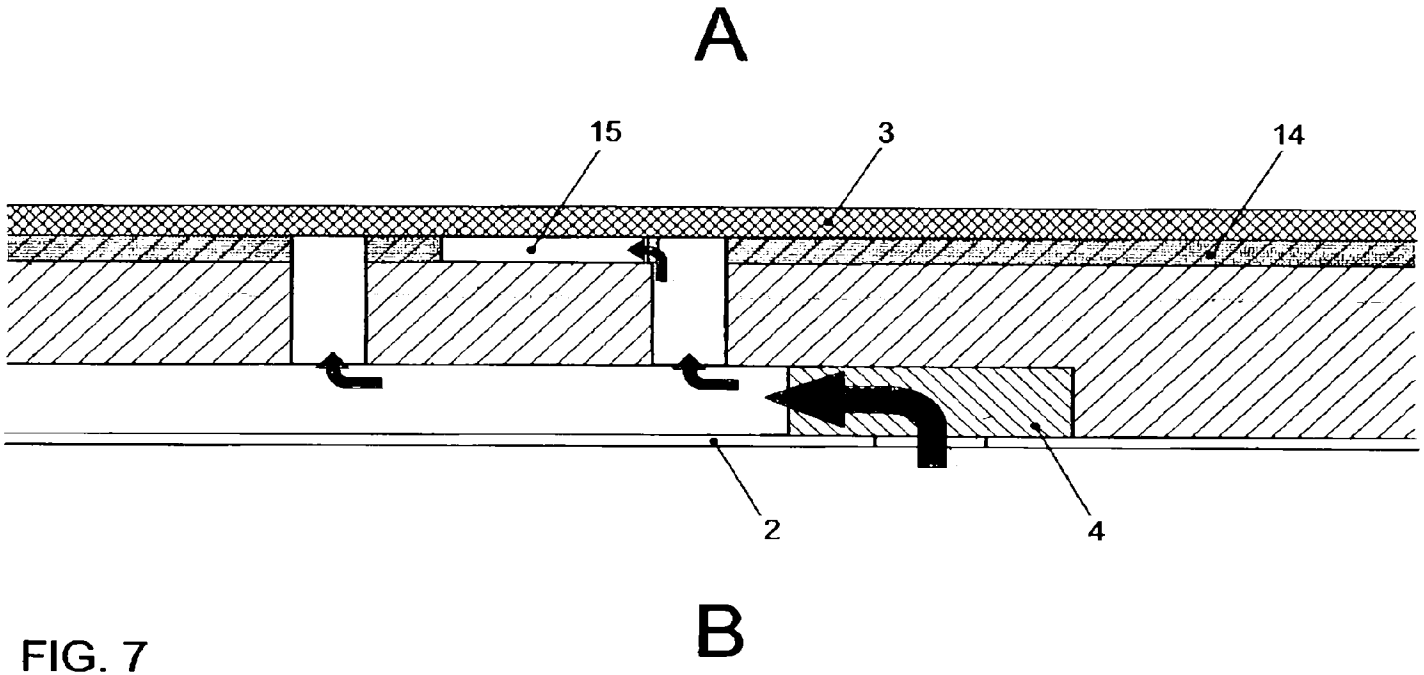
FIG. 7 illustrates the system as shown in FIG. 1 using cut-foam layers having cut-outs that form the air trenches on the A side.

Such larger air outlet regions on the A side or air trenches 13 on the A side may also be formed by separate cut-foam layers 14. These are prepared by corresponding cuts or cutouts 15 of the subsequent air trenches 13 or distribution structures and are positioned between the foam and the cover on the A side (FIG. 7).

Figure 8:
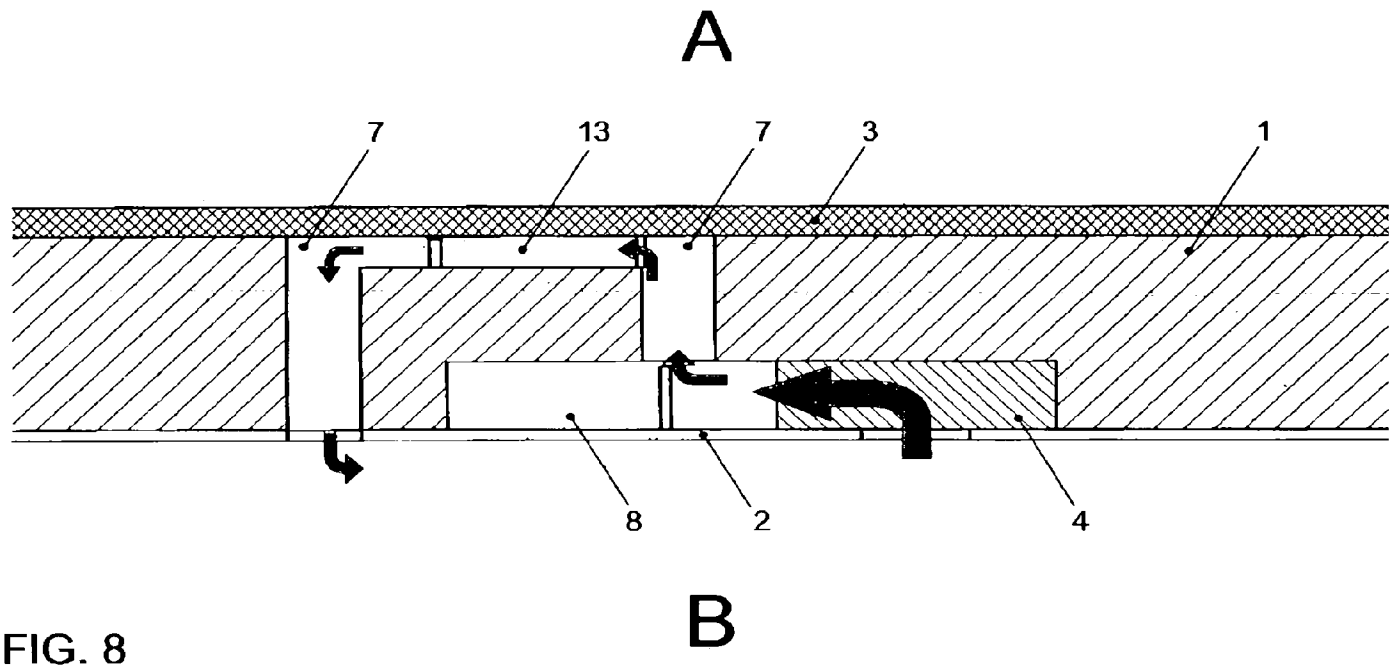
FIG. 8 illustrates the system as shown in FIG. 1 using air trenches on the A side and an arrangement such that the air is returned to the B side (backflow).

If these air trenches 13 on the A side are provided such that they are in operative connection with two air conducting channels 7, an air conducting device 5 including a backflow may also be achieved. Air flows from the ventilator through an air trench 8 on the B side, through a first air conducting channel 7, then through an air trench 13 on the A side and back through a second air conducting channel 7, which ends directly on the B side (FIG. 8).

Figure 9:
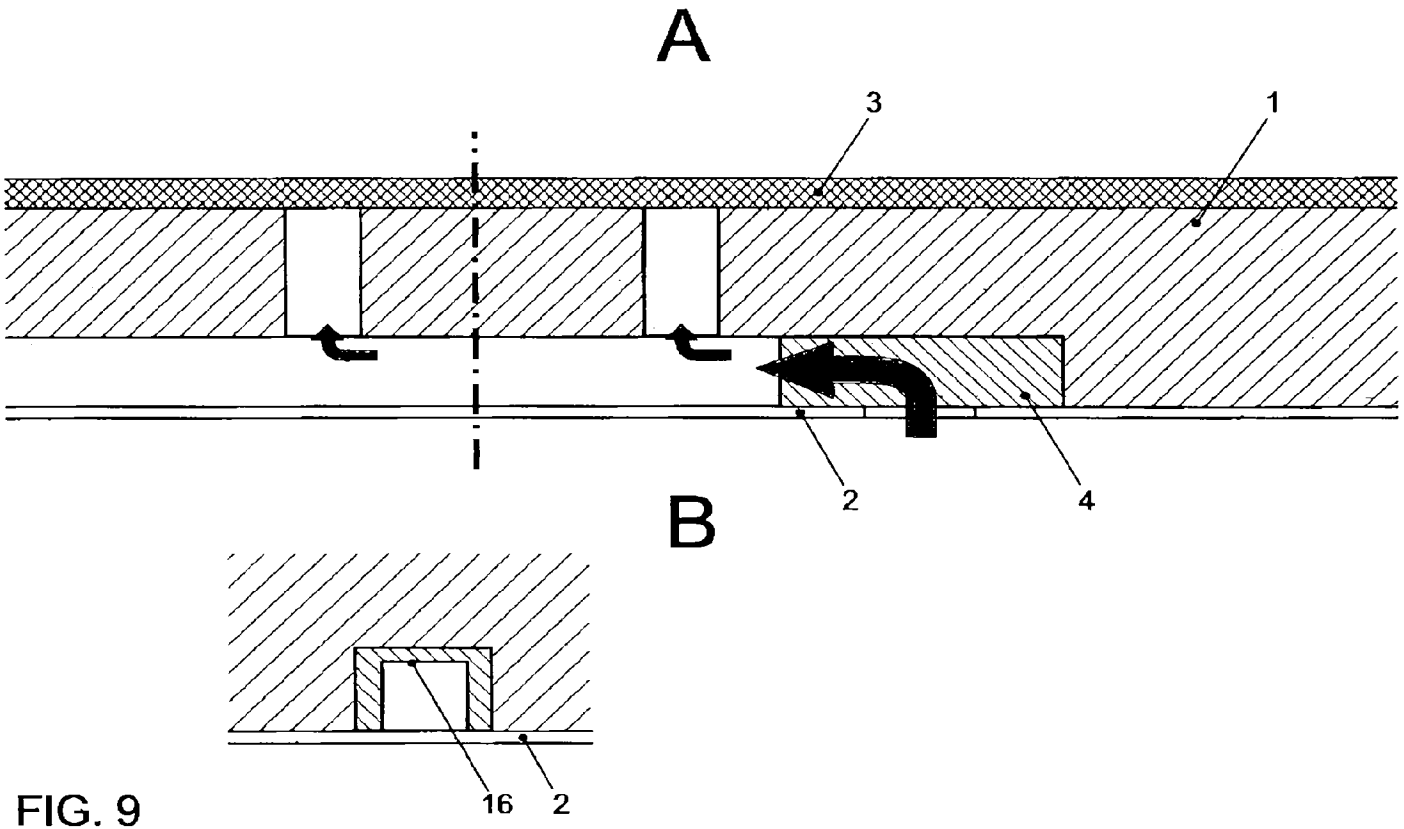
FIG. 9 illustrates the system as shown in FIG. 1 using flocculated composite foam in the air distribution device.
Figure 10:
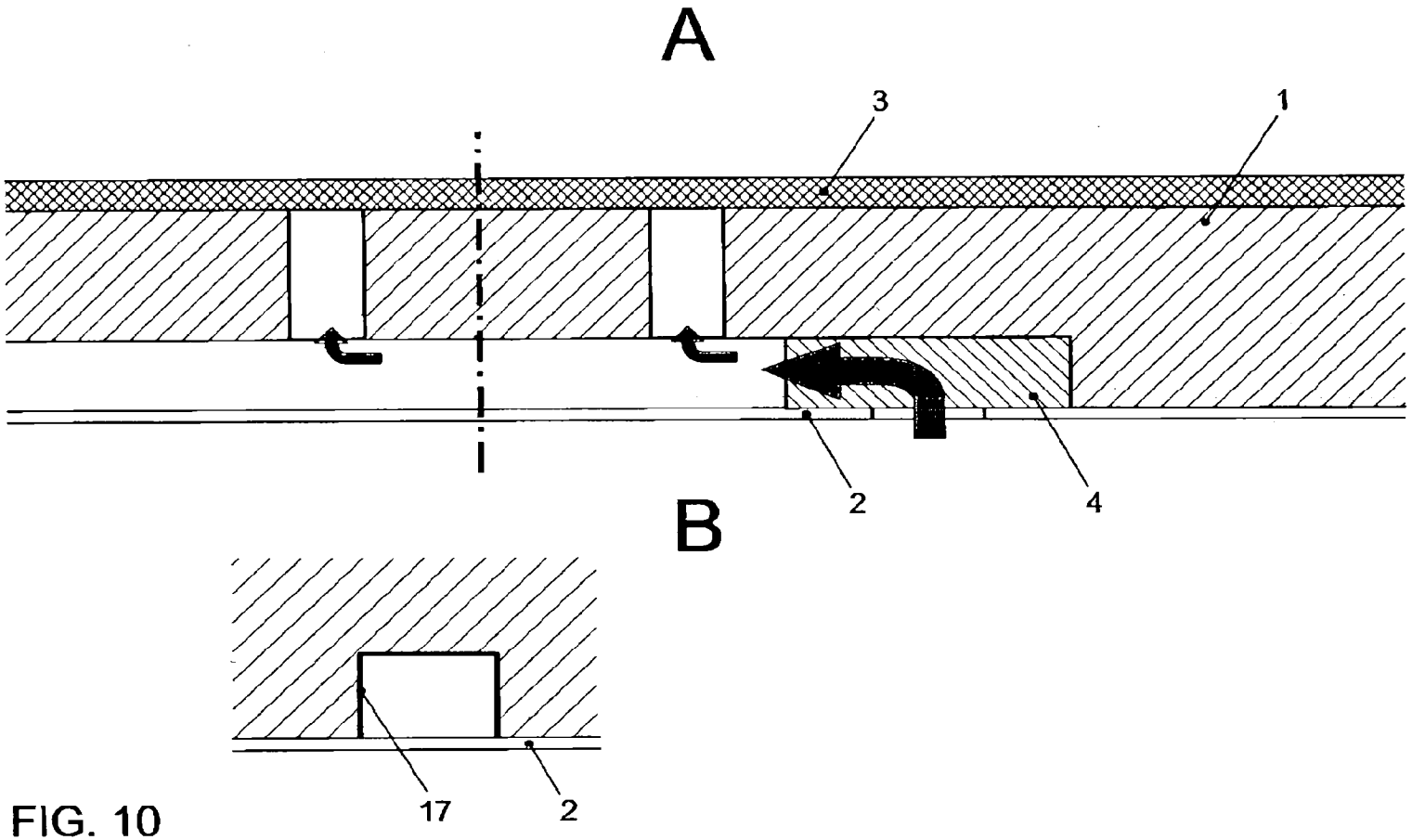

FIGS. 9 and 10 show additional possibilities of stabilizing air trenches 8.

According to the variant as shown in FIG. 9, the inner surface of air trenches 8 is formed by a flocculated composite foam 16, which stabilizes as a harder material.

Another example embodiment is shown in FIG. 10; in this instance, the inner surface of air trench 8 is reinforced against load with the aid of a harder material that may be sprayed on. This adhesive 17 may be a rubberized skin.

Figure 17:
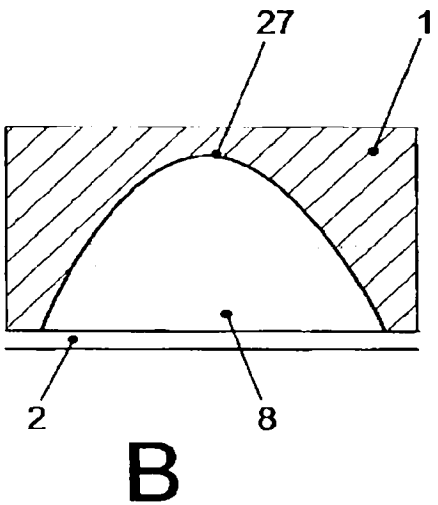
FIG. 17 illustrates a second special form design for stabilizing an air trench.
Figure 16:
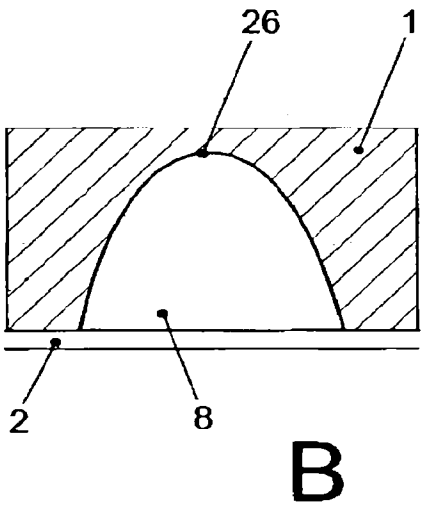
FIG. 16 illustrates a first special form design for stabilizing an air trench.

FIGS. 16 and 17 show even further possibilities of stabilizing air trenches 8 and/or 13. The stabilization of the shape of air trenches 8 and/or 13 by optimizing the load distribution or the force distribution onto air trench 8 and/or 13 is achieved by special form designs 26, 27 of air trenches 8 and/or 13.

As shown in FIG. 16, in a first special form design 26 sloping walls are implemented, which are provided so as to terminate in an arch in the direction of the seated person (A side).

As shown in FIG. 17, in a second special form design 27 parabolic walls are implemented, the closed region of the parabola being again implemented in the direction of the seated person (A side).

In this form design 26, 27, placing a load on air trenches 8 and/or 13 results in a smaller change of the cross-section of air trench 8 and/or 13 such that the desired preconfigured flow conditions are substantially maintained.

Moreover, in both cases the danger of pressing through or wearing out in the region of air trenches 8 and/or 13 is reduced since these have a higher stability.

Figure 11:
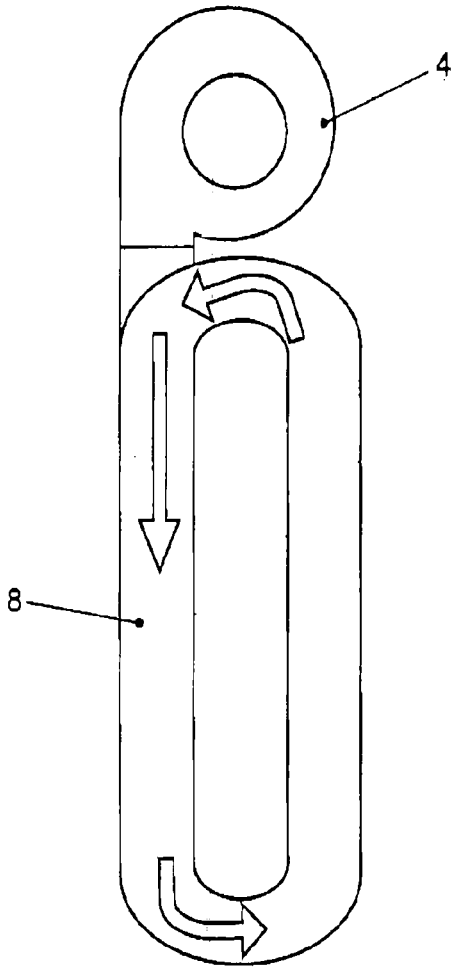
FIG. 11 is a representation of an air distribution structure having a circular air trench.

It may be advantageous to produce a suction effect via air distribution structure 6, as is shown with the aid of FIG. 11. This structure overall has a circular shape and allows for a circulating flow. Air is blown into the distribution structure by laterally situated ventilator 4 and is returned to the point where it was blown in, the suction effect then ensuing in the process. Along the ring distribution structure, air conducting channels 7, extending substantially transversely with respect to the ring distribution structure, are situated toward the A side in order to transport the air to the A side.

Figure 12:
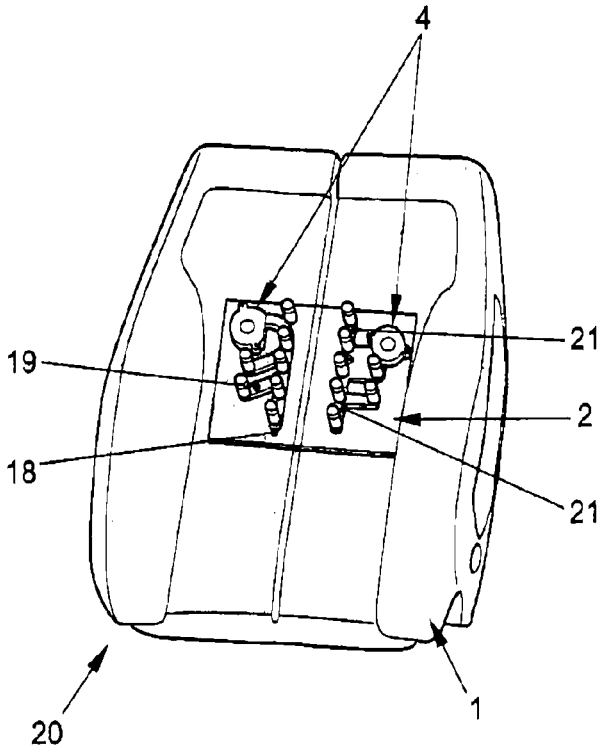
FIG. 12 is a representation of a B side of a seat back having a ventilator integrated into the seat back foam and an air distribution structure.

FIG. 12 represents another pattern of an air distribution structure 6—in this instance in a seat back foam. Two radial ventilators 4 and two air distribution structures 6 are situated in each seat back 20. The air flows on the left side via a substantially main distribution branch 18 and two side branches 19 along the B side of seat back 20 and via the latter into the transversely situated air conducting channels 7. A pattern having substantially two distribution branches 21 is shown on the right.

Figure 13:
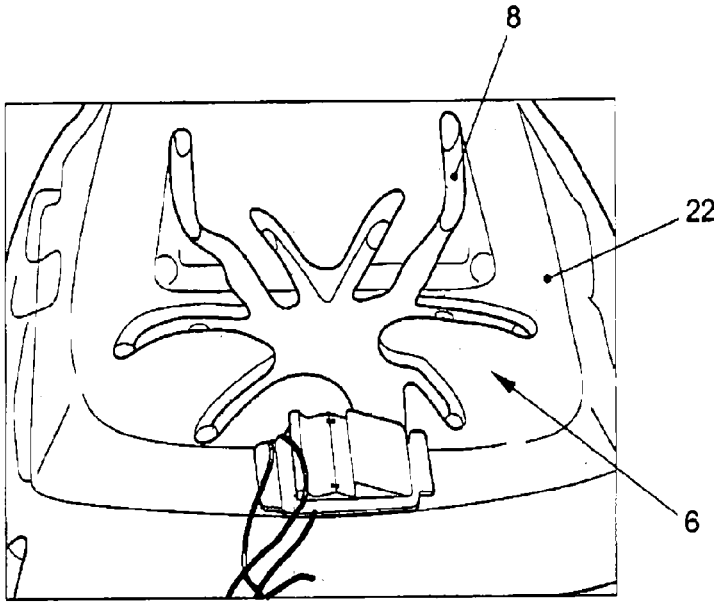
FIG. 13 is a representation of a star-shaped air distribution structure on the B side of a seat cushion.

With the aid of the provided air distribution structure 6 and air trenches 8 on the B side of a foam cushion it is possible to provide arbitrary distribution patterns, which will also accommodate the comfort requirements of the seated person at the individual body regions. Thus it may be advantageous, for example, to provide less cooling to the kidney areas or selectively to cool other body areas more. Such a pattern is shown by FIG. 13. Air trenches 8 dispersing in the shape of a star are introduced into the foam material on the B side of a seat cushion or seat part 22. These are supplied by a radial ventilator 4, which is situated at one end point of an air trench 8. Two air trenches 8 may be extended out into the leg regions.

Figure 14:
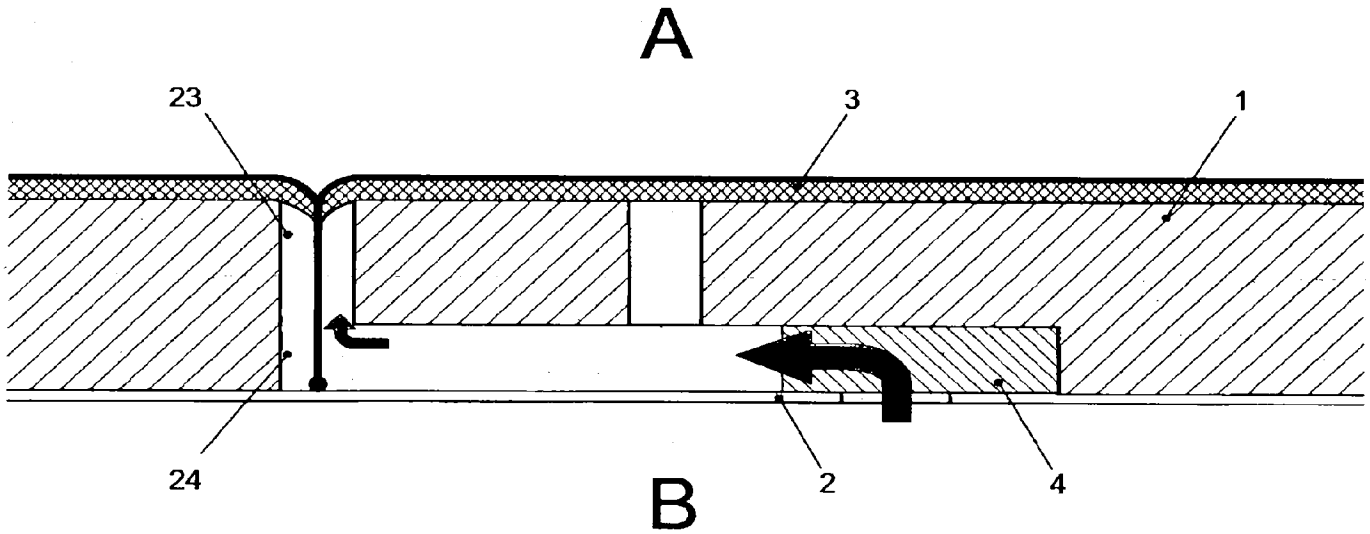
FIG. 14 is a representation in accordance with FIG. 1, tack trenches being used as air conducting channels.
Figure 15:
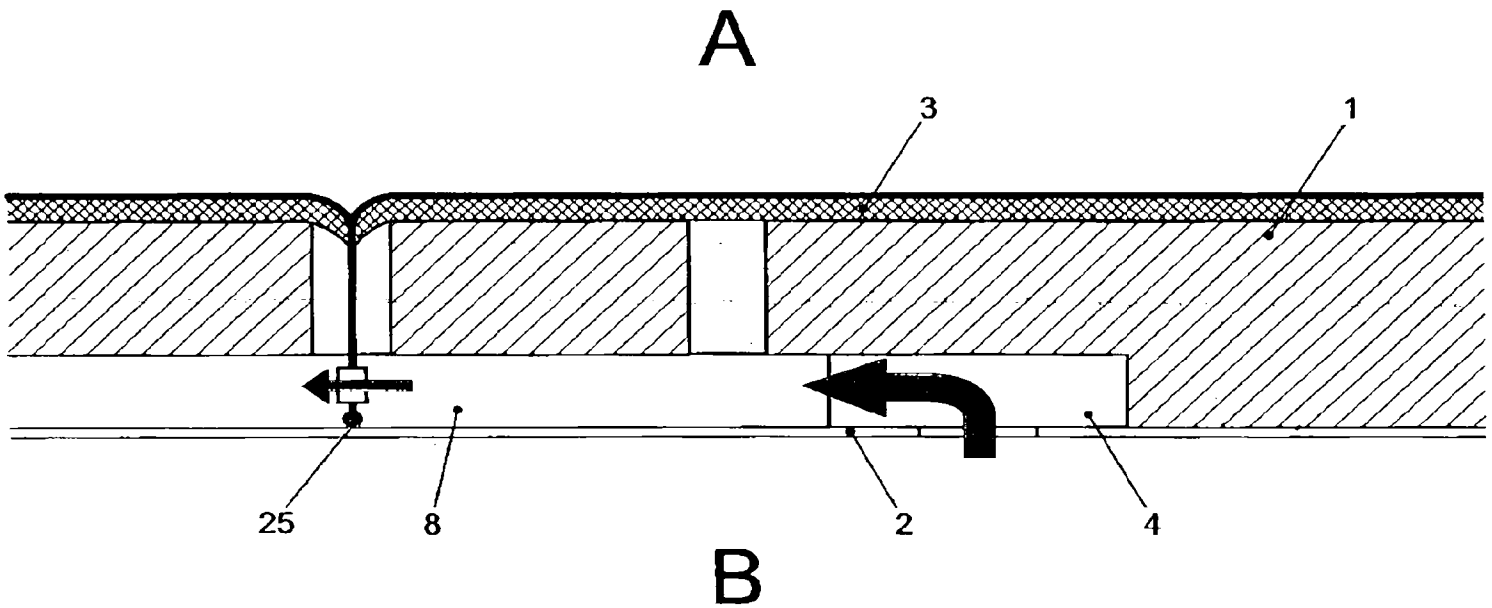
FIG. 15 is a representation in accordance with FIG. 14 having a perforated tack trench.

As just described, air conducting channels 7 which extend from the B side to the A side are used for transporting the air. For this transport, tack trenches 23 may also be used, which exist for retaining the cover or cover web 24 in the foam cushion. Such an arrangement is shown with the aid of FIG. 14. In a further development of this example embodiment, cover webs 25 themselves may be punched or perforated and may thus also extend transversely through an air trench 8 on the B side. This has the advantage that an air trench 8 may extend below a tack trench 23, which increases the variability of the patterns in the air distribution structures.

Example embodiments of the present invention provide an aspirating ventilator 4 which is fastened on the foam or situated in the foam. In this manner, a cooling effect is achieved for the seated person with the aid of the air distribution structure 6 and air conducting channels 7, or even a removal of moisture (not shown).

FIGS. 18 through 25 show a simple installation and alternative additional solutions for fastening ventilator 4 in the foam, particularly in foam zone 12 separately provided for ventilator 4, in which, according to the specification provided so far, ventilator 4 is embedded and fixed in place in accordance with the arrangement described with reference to FIG. 5. First, the installation solution "button hole solution" in an example embodiment is explained with reference to the cross-sectional view (lower illustration) and a bottom view (upper illustration) of FIG. 18.

As shown in the lower illustration, ventilator 4 must be inserted into cavity 31 of the foam, in particular of the separately provided fixation layer, which in particular is arranged as foam zone 12.

Figure 18:
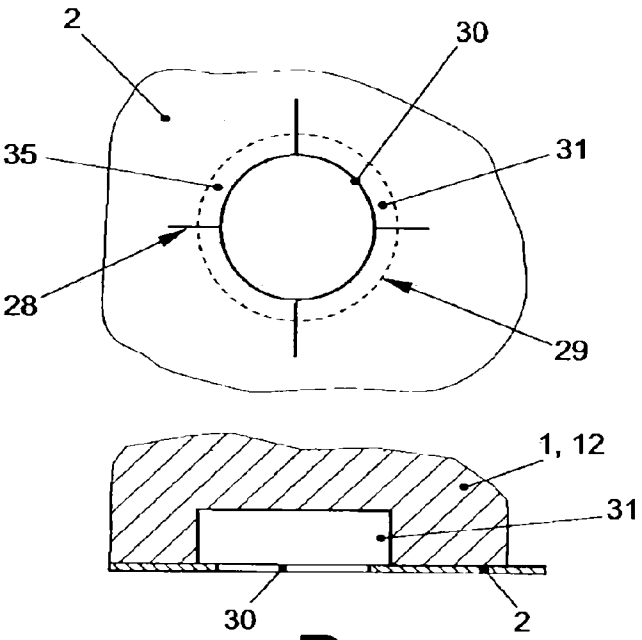
FIG. 18 illustrates a mounting solution "button hole solution" in a cross-sectional view (lower drawing) and in a bottom view (upper drawing).

The bottom side (B side) of a seat area or seat back, however, is already provided with non-woven fabric 2 during the manufacturing process. For installation purposes, non-woven fabric 2, see FIG. 18, is provided with cuts 28 in the manner of a button hole—"button hole solution"—, which extend from an installation opening 20, the "button hole", orthogonally to the installation axis of ventilator 4.

The length of cuts 28 depends on the flexibility of the utilized non-woven fabric 2.

Once the installation is complete, non-woven fabric 2 covers ventilator 4 in overlaps 35, which results in additional support for ventilator 4.

Cavity 31 in foam zone 12 preferably has already been produced in accordance with the contour of ventilator 4, so that the only task actually remaining during the installation is "threading" or "buttoning" ventilator 4 through non-woven fabric 2.

Figure 19:
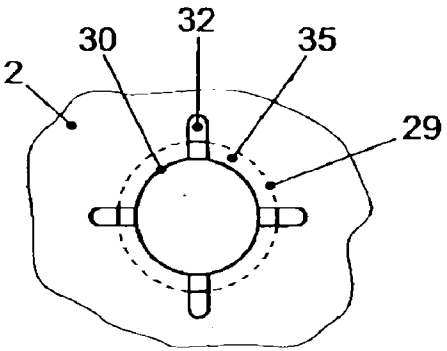
FIG. 19 illustrates a mounting solution in a bottom view.

Analogously to the upper illustration of FIG. 18, FIG. 19 shows a similar approach in a further example embodiment, in which recesses 32 have been implemented instead of corresponding cuts 28. This example embodiment, which is likewise shown in a bottom view, lends itself to less flexible non-woven fabrics. As illustrated, other overlap regions 35 result.

Figure 21:
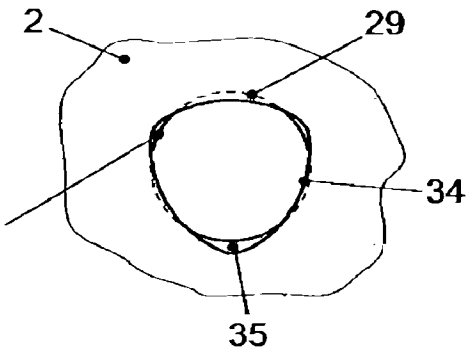
FIG. 21 illustrates a mounting solution in a bottom view.
Figure 20:
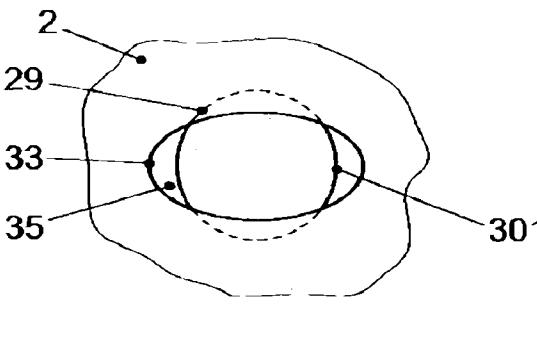
FIG. 20 illustrates a mounting solution in a bottom view.

Furthermore, FIGS. 20 and 21 show example embodiments in a bottom view, in which cuts 28 or recesses 32 in non-woven fabric 2 are omitted and overlap regions 35 between non-woven fabric 2 and ventilator 4 are produced in that "button hole" 30, i.e., the installation opening through non-woven fabric 2, now no longer is round but oval according to FIG. 20, or in that it deviates slightly from a round form according to FIG. 21.

This approach results in overlap regions 35 shown in FIG. 20 or 21, whereby a ventilator 4 is retained, in addition to the described measures, by non-woven fabric 2 inside cavity 31 or whereby its installation is able to be undertaken in an especially uncomplicated manner.

Figure 22:
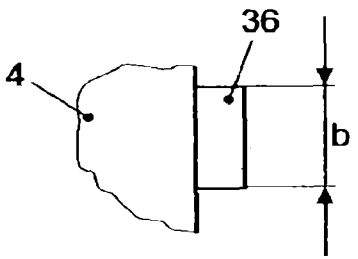
FIG. 22 illustrates a first fastening solution of a ventilator in the cavity provided for it in a top view, with flexible retaining elements.
Figure 23:
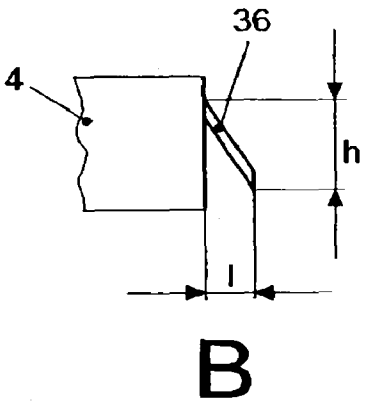
FIG. 23 illustrates a first fastening solution of a ventilator in the cavity provided for it in a cross-sectional view on a ventilator, with flexible retaining elements.
Figure 25:
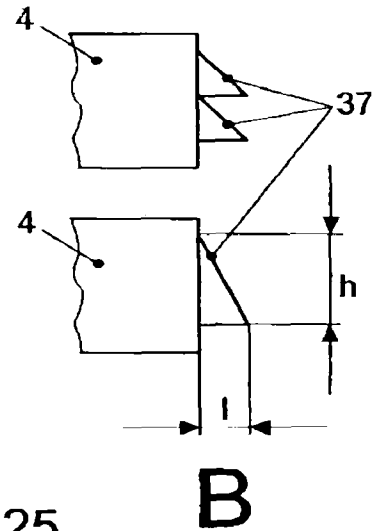
FIG. 25 illustrates the second fastening solution of a ventilator in the cavity provided for it in a cross-sectional view, with rigid retaining elements.

To ensure further fixation of ventilator 4 in foam 1 or, according to the described example embodiments, in a foam zone 12—a separate fixation layer—, FIGS. 22 and 23 show a first affixation approach using flexible retaining elements 36, which are shown in FIG. 22 in a plan view of a ventilator and in FIG. 23 in a side view in the direction of the ventilator.

Following the described installation of ventilator 4 and "threading-in" or "buttoning-in" of ventilator 4 into cavity 31 provided for this purpose, the flexible retaining element achieves a fixation of ventilator 4 in the form of a barb. Of course, this requires that foam zone 12 has previously already been adapted to ventilator 4 in its dimensions and contour, so that flexible retaining elements 36 are able to be properly pressed against ventilator 4 during installation and, as soon as ventilator 4 has assumed its desired position, support themselves at foam zone 12.

Figure 24:
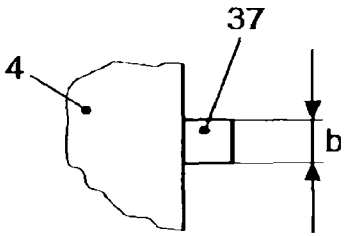
FIG. 24 illustrates a second fastening solution of a ventilator in the cavity provided for it in a top view, with rigid retaining elements.

A similar situation presents itself for a second affixation approach according to FIG. 24 and according to FIG. 25, which again show a plan view of a ventilator 4 or a section through a ventilator 4. In this case, no flexible retaining elements 36 are involved but rigid retaining elements 37, which actually catch in the manner of barbs in foam zone 12, which is not illustrated in FIGS. 22 to 25, it being apparent according to FIG. 25 that a plurality of retaining elements 37 may be installed just as well. The potential multiple placement also applies to the flexible retaining elements according to FIGS. 22, 23.

LIST OF REFERENCE CHARACTERS

1 (cushion) foam
2 non-woven fabric
3 cover
4 (radial) ventilator
5 air distribution device
6 air distribution structure
7 air-conducting channels
8 air trenches (on B side)
9 knitted spacer fabric
10 2-zone foam
11 zone boundary
12 separate fixation layer for ventilator
13 air trench on A side
14 cut-foam layer
15 cut-out
16 composite foam
17 spray adhesive/rubber skin
18 main distribution branch
19 side branch
20 seat back
21 distribution branch
22 seat area or seat part
23 tack trench
24 cover web
25 perforated cover web
26 first form design
27 second form design
28 non-woven fabric cut-out—cuts
29 contour
30 installation opening "button hole"
31 cavity
32 non-woven fabric cutout—recesses
33 non-woven fabric cutout—oval
34 non-woven cut-out—virtually round
35 overlaps, overlap regions
36 flexible retaining elements
37 rigid retaining elements

What is claimed is:

1. An air-conditioned seat, comprising:
a seat part;
a seat back;
an air distribution device; and
a ventilator;
wherein at least one of the seat part and/or the seat back is upholstered with foam, the air distribution device arranged in the foam, the ventilator in operative connection with the air distribution device;
wherein the air distribution device includes an air distribution structure on a B side facing an interior of the at least one of the seat part and/or the seat back and air-conducting channels toward an A side facing an exterior of the at least one of the seat part and/or the seat back;
wherein the ventilator is provided within the foam on the B side, the air distribution structure and the air-conducting channel adapted to transport air to the A side, the air distribution structure including as air trenches in the foam on the B side; and
wherein at least one air-conducting channel is formed by a tack trench, through which a cover web extends to fix a cover in place on the foam.

2. The air-conditioned seat according to claim 1, wherein the ventilator is arranged as a radial ventilator.

3. The air-conditioned seat according to claim 1, wherein an inner side of the air distribution device is stabilized by a composite foam.

4. The air-conditioned seat according to claim 1, wherein an inner side of the air distribution device is stabilized by at least one of a sprayed-on, harder material, a rubberized skin, and/or a spray adhesive.

5. The air-conditioned seat according to claim 1, wherein the air distribution device includes a ring channel structure that allows a circulating flow.

6. The air-conditioned seat according to claim 1, wherein the air-distribution structure has a substantially star-shaped configuration.

7. The air-conditioned seat according to claim 1, wherein at least one of air trenches on the B side and/or air trenches on the A side are stabilized by at least special form arrangement.

8. The air-conditioned seat according to claim 1, wherein at least one of the foam, the seat back, and/or the seat part is delimited on the B side by a non-woven fabric having an installation opening, which in conjunction with a cavity arranged as an installation location of the ventilator, forms overlap regions, a flexibility of the installation opening for installation of the ventilator in at least one of:

with larger overlap regions by non-woven fabric cutouts with at least one of cuts and/or recesses; and/or with smaller overlap regions by non-woven fabric cut-outs having special forms.

9. The air-conditioned seat according to claim 1, wherein the ventilator is fixed in place in the foam.

10. The air-conditioned seat according to claim 9, wherein the ventilator is fixed in place in at least one of the foam, a separate fixation layer, and/or a foam zone by at least one of a flexible and/or a rigid retaining device arranged at the ventilator.

11. The air-conditioned seat according to claim 1, further comprising an air-permeable material arranged on the A side between the foam and a cover enclosing the seat toward an outside.

12. The air-conditioned seat according to claim 11, wherein the air-permeable material includes at least one of a knitted spacer fabric, rubberized hair, and/or a reticulated foam.

13. The air-conditioned seat according to claim 1, further comprising an air-permeable material arranged on the B side between the foam and a layer surrounding the foam.

14. The air-conditioned seat according to claim 13, wherein the air-permeable material includes at least one of a knitted spacer fabric, rubberized hair, a reticulated foam, and/or a non-woven fabric layer.

15. The air-conditioned seat according to claim 1, wherein the cover web extends along the tack trench and through an air trench extending transversely to the tack trench, on the B side and is fixed in place on the B side, and the cover web has at least one perforation in a region of the air trench to ensure an air flow through the air trench.

16. The air-conditioned seat according to claim 15, wherein the cover web is made of a lattice web.

17. The air-conditioned seat according to claim 1, wherein the foam includes foam zones of different types.

18. The air-conditioned seat according to claim 17, wherein the ventilator is embedded in a separate foam zone that fixes the ventilator in place.

19. The air-conditioned seat according to claim 17, wherein a foam having a harder consistency extends at least along the air distribution structure facing the B side and is adapted to stabilize the air distribution structure.

20. The air-conditioned seat according to claim 1, wherein the air-conducting channels extend transversely through the foam, air trenches provided at an end of the air-conducting channels are disposed toward the A side and extend transversely to the air-conducting channels.

21. The air-conditioned seat according to claim 20, wherein a zone including the air trenches is formed by a separate cut-foam layer having corresponding cut-outs in operative connection with the air-conducting channels.

22. The air-conditioned seat according to claim 20, wherein the air trenches disposed toward the A side are connected to corresponding air-conducting channels to transport air from the ventilator to the A side, then via an air trench along the A side and from there, back to the B side for back flow.

23. An air-conditioned seat, comprising:

a seat area;

a backrest;

a ventilator; and an air distribution device;

wherein at least one of the seat area and/or the backrest is cushioned with foam, the air distribution device arranged in the foam;

wherein the ventilator is in operative connection with the air distribution device, the air distribution device including an air-distribution structure on a B side facing an interior of the at least one of the seat area and/or the backrest and air-conducting channels toward an A side facing an exterior of the at least one of the seat area and/or the backrest;

wherein the ventilator has an aspirating effect, air being transportable from the A side to the B side; and wherein at least one air-conducting channel is formed by a tack trench, through which a cover web extends to fix a cover in place on the foam.

* * * * *

UNITED STATES PATENT AND TRADEMARK OFFICE

CERTIFICATE OF CORRECTION

PATENT NO. : 8,388,057 B2
APPLICATION NO. : 12/375342
DATED : March 5, 2013
INVENTOR(S) : Barkow et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 737 days.

Signed and Sealed this
First Day of September, 2015

Michelle K. Lee

Michelle K. Lee
*Director of the United States Patent and Trademark Office*